US005755948A

United States Patent [19]

Lazaro et al.

[11] Patent Number: 5,755,948

[45] Date of Patent: May 26, 1998

[54] ELECTROPLATING SYSTEM AND PROCESS

[75] Inventors: Anton Ernest Lazaro, Park Ridge; Peter Heinrich Tremmel, Chicago, both of Ill.

[73] Assignee: Hardwood Line Manufacturing Co., Chicago, Ill.

[21] Appl. No.: 786,872

[22] Filed: Jan. 23, 1997

[51] Int. Cl.[6] ..... C25D 5/00; C25D 7/00; C25D 17/00; C25B 15/00

[52] U.S. Cl. ..... 205/143; 205/145; 204/201; 204/213; 204/237

[58] Field of Search ..... 205/143, 145; 204/201, 213, 237

[56] References Cited

U.S. PATENT DOCUMENTS

| | | | |
|---|---|---|---|
| 1,595,108 | 8/1926 | McCormick | 204/213 |
| 3,926,666 | 12/1975 | McInnes | 134/25 R |
| 3,945,388 | 3/1976 | Clark | 134/57 R |
| 4,062,752 | 12/1977 | Peterson | 204/201 |
| 4,390,399 | 6/1983 | McInnes | 204/32 R |
| 5,433,834 | 7/1995 | Belz et al. | 204/213 |

*Primary Examiner*—Kathryn L. Gorgos
*Assistant Examiner*—Edna Wong
*Attorney, Agent, or Firm*—Irwin C. Alter

[57] ABSTRACT

This invention relates to a system and process for electroplating that has plating drums whereby the plating drums are filled, and emptied of parts at each individual plating cell and the parts are cleansed by spraying, wiping and/or drying and whereby only cleansed parts are transported from plating cell to plating cell. This results in less contamination and higher efficiencies in plating.

15 Claims, 9 Drawing Sheets

ELECTROPLATING SYSTEM AND PROCESS

Figure 1:
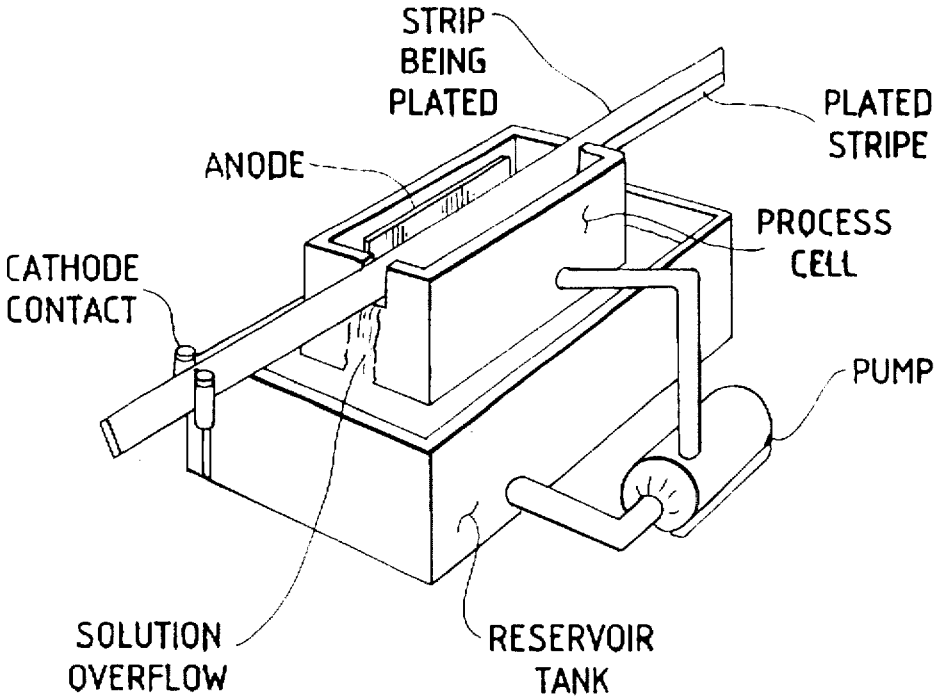
FIG. 1 PRIOR ART

This invention relates to a new and improved electroplating system and process wherein the processing speed of plating is enhanced while certain costs are reduced, due to faster cycle time. Also, it achieves higher current density, and, among other things, lower water treatment costs due to lower contamination of solutions. The system processes parts with plating drums that have plate dipped parts in chemical solution and thereafter the parts are unloaded and cleansed so that less contamination occurs than in the conventional type of barrel plating systems where the parts are not dried or removed from the barrels. Thus contamination occurs when uncleansed parts and barrels are dipped in succeeding chemical solutions.

In prior art electroplating, where there are loose parts that are smaller and discrete, the usual method of electroplating employed is "barrel plating."

Barrel plating employs perforated barrels that are usually dipped into various types of rinses and electroplating solutions while the discrete parts remain in the barrel. Therefore, contamination of various solutions occurs by failure to isolate each of the solutions as well as by failure to clean and dry the parts and the barrels before the barrel is dipped in different solutions.

Two other popular alternatives to barrel plating are "continuous line plating" and "rack plating." While rack plating does not use a barrel, it has many of the drawbacks of barrel plating due to dipping the parts in different solutions without cleaning and drying the barrel or the parts. Continuous line plating does not furnish a satisfactory alternative to plating most small discrete parts.

SUMMARY AND OBJECTS OF THE INVENTION

It is therefore a main object of this invention to provide a drum or a plurality of drums that can each be selectively loaded and unloaded with parts and can be submerged in a solution with selectable levels of the solution and rotated to agitate parts and thereafter have the parts unloaded and cleaned and have the solution contained therein exhausted and be replenished in an existing bath that corresponds to the drum or to each drum where a plurality of drums are employed.

It is a further object of this invention to achieve a continuous plating process by transferring loose discrete parts from plating cell to plating cell instead of transferring parts on a continuous strip or transferring plating barrels containing parts as in the prior art.

It is still further object of this invention to provide a continuous flow of parts through the plating system and through the plating drums or drums in a manner whereby the plating drum provides entrance and egress of the parts through respective entrance and exit apertures defined in the drum end plates where the plating drum is journalled.

Still it is a further object of this invention to provide a faster plating rate and more uniform and higher quality plating finishes by means of concentric semi-cylindrical anodes for the plating drums in the system in proximity to the outside of the plating drums which provides a more uniform current density in the chemical bath between the anode and cathode.

It is even still further an object of this invention to provide horizontal advancement of the parts in the system when loading and unloading parts from the plating drums by means of an auger-shaped cathode. Said auger-shaped cathode also promotes better agitation of the parts during the plating cycle as the plating drum rotates; and said cathode also promotes higher current density by being in intimate contact with the parts.

It is still even further an object of this invention to enable the level of chemical solution to be raised and lowered to preselected levels by means of moveable weirs while the plating drum remains rotatable. This eliminates need of removing the plating drum from the plating cell in order to remove the parts from immersion in the chemical bath. Since only the dried parts are transferred to different plating cells, there is less contamination of the chemical baths than in the prior art.

By means of a drum or a plurality of drums, the drum devices as well as the process can achieve higher quality plating finishes that are similar to a continuous plating process as explained in METAL FINISHING GUIDEBOOK AND DIRECTORY, 1990 EDITION. See pp. 621–624, entitled: CONTINUOUS STRIP PLATING OF ELECTRICAL COMPONENTS.

In order to show a preferred embodiment of this invention, it is well to explain that just as in the continuous strip plating or reel to reel plating, each of the drum units of this invention is associated with a main reservoir tank containing liquid solution with chemical characteristics to perform the given tasks of cleaning, etching and or activation as in preplating, plating and post-plating which can include everything from precious metal recovery, or any special post plating treatments of cleaning, rinsing, drying, etc.

DESCRIPTION OF THE DRAWINGS AND SPECIFICATION

Figure 2A:
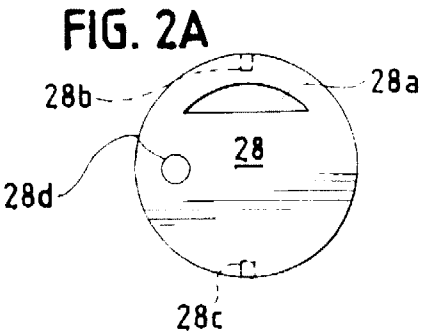
Figure 3:
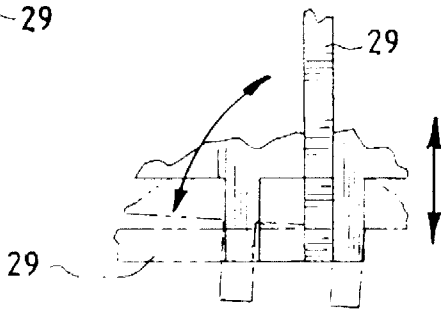
Figure 2:
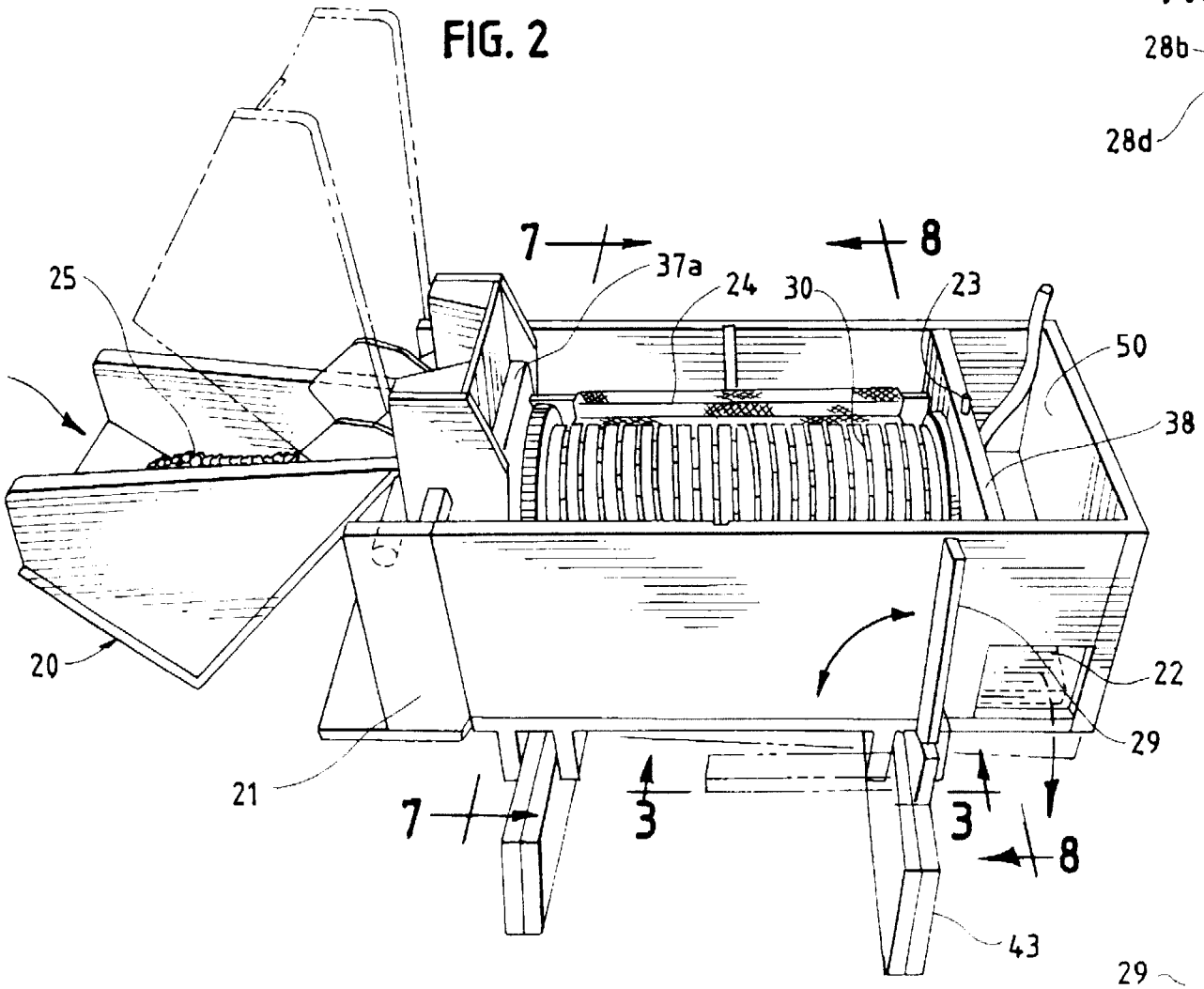
Figure 4:
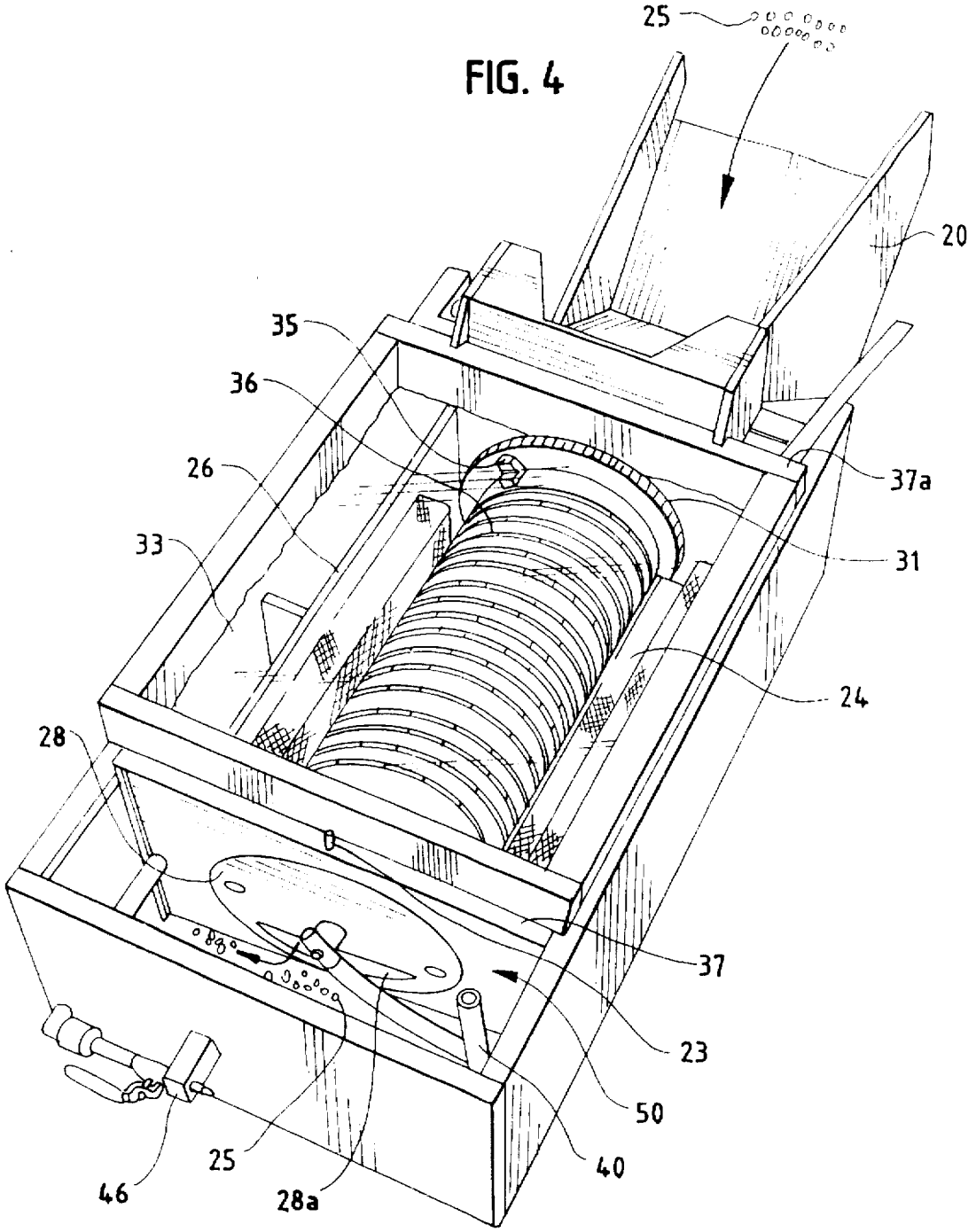
Figure 5:
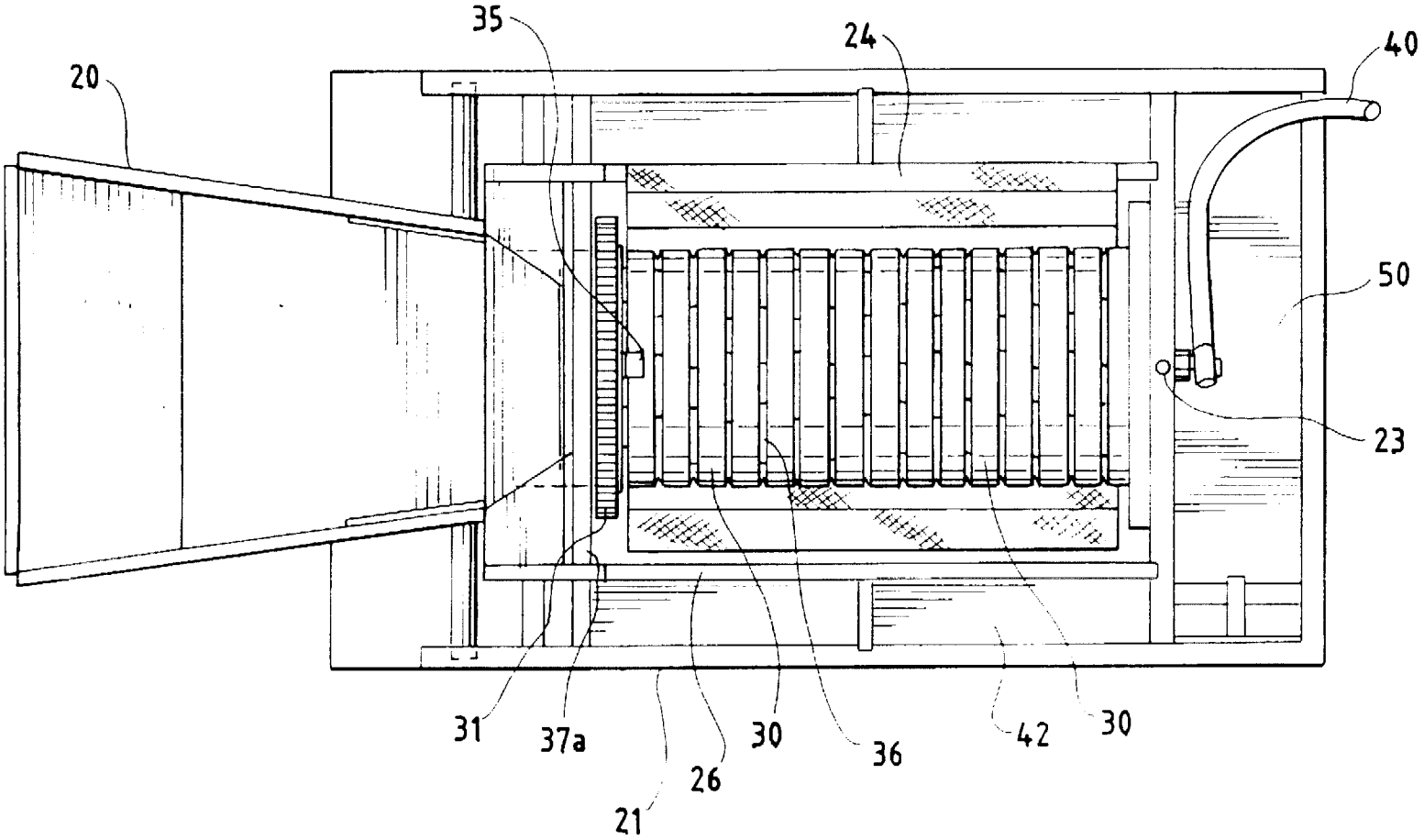
Figure 6:
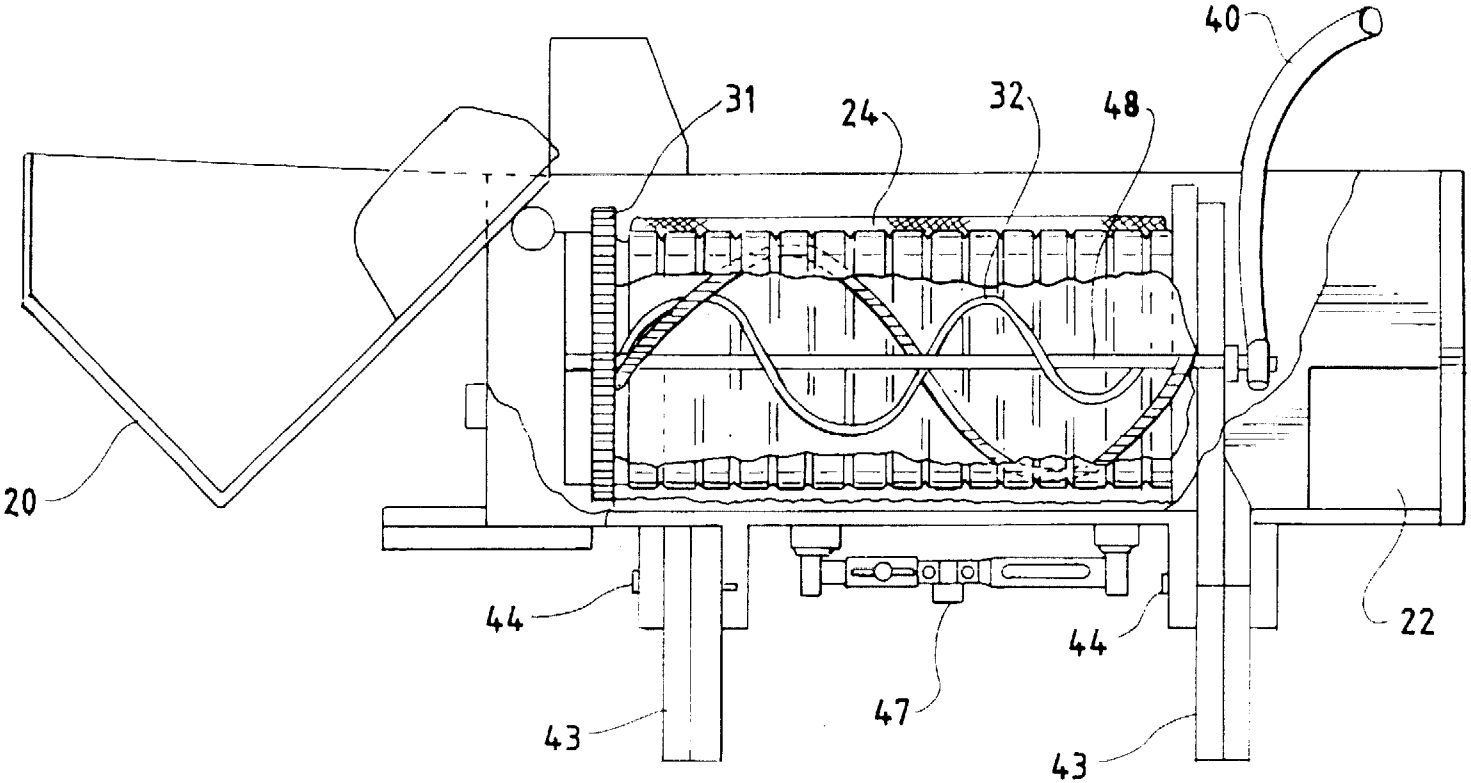
Figure 7:
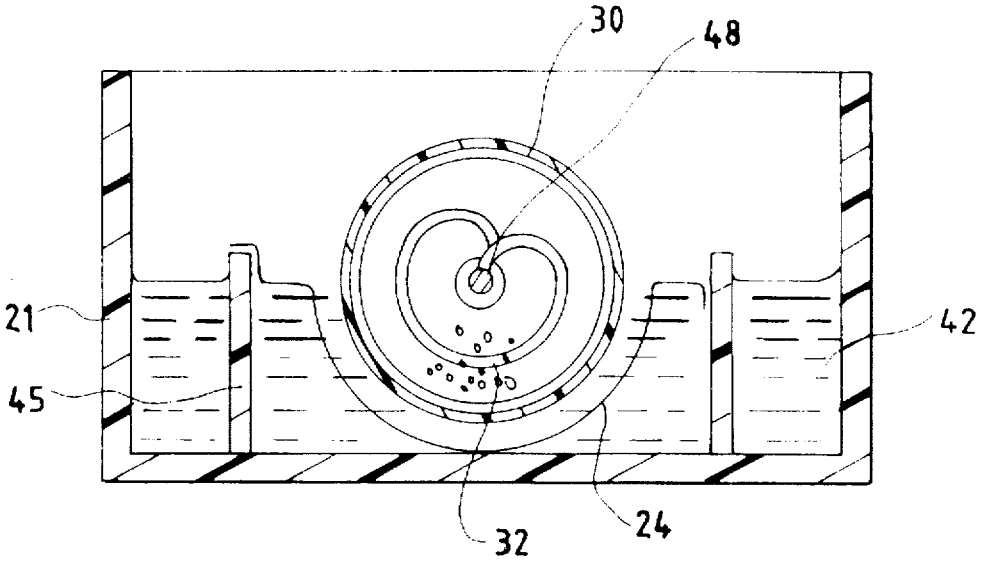
Figure 8:
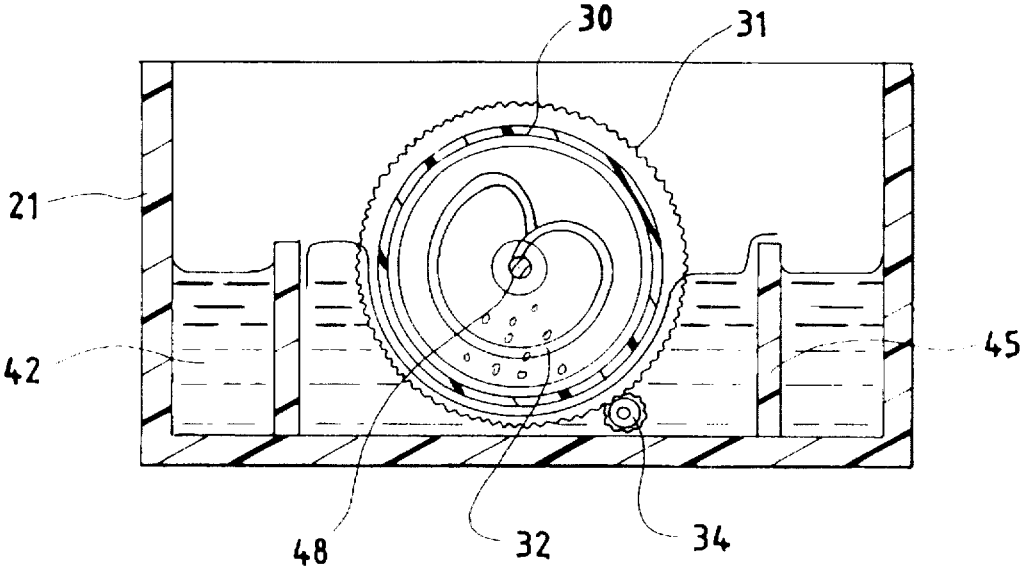
Figure 9:
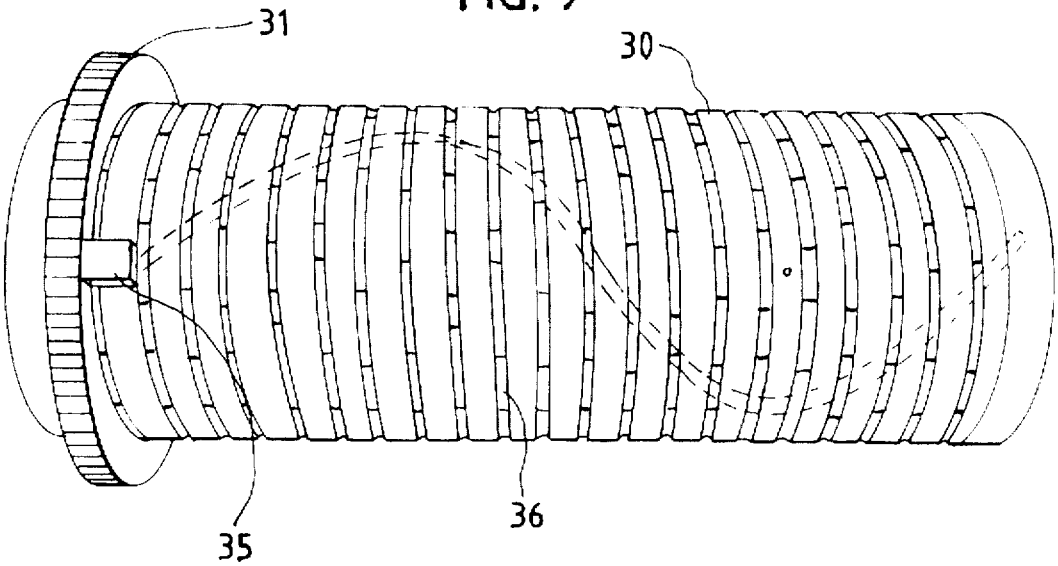
Figure 10:
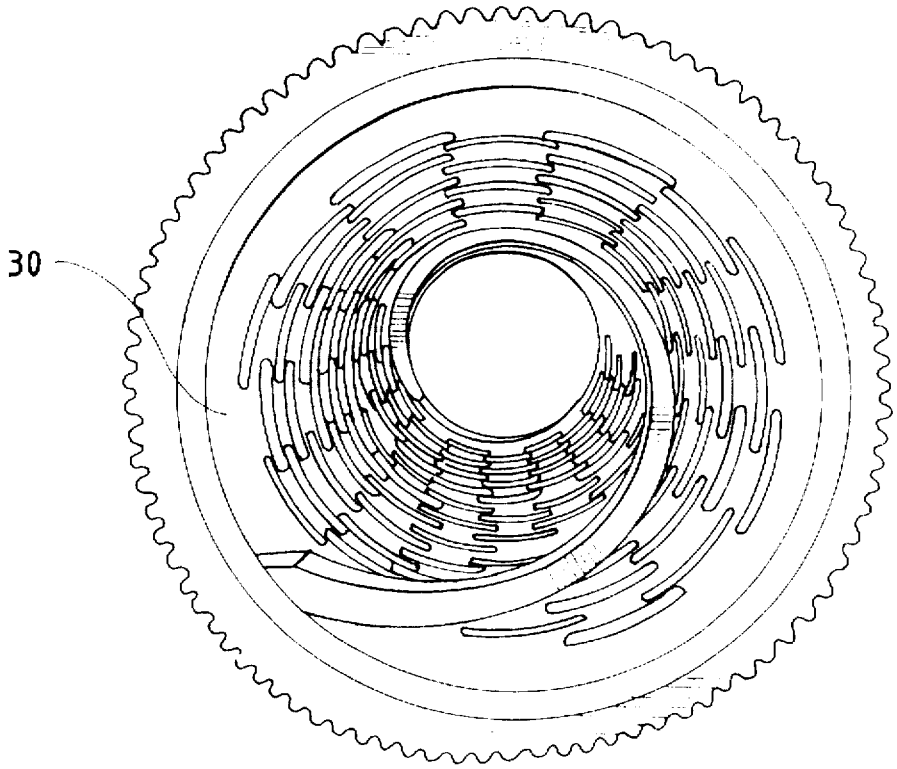
Figure 11:
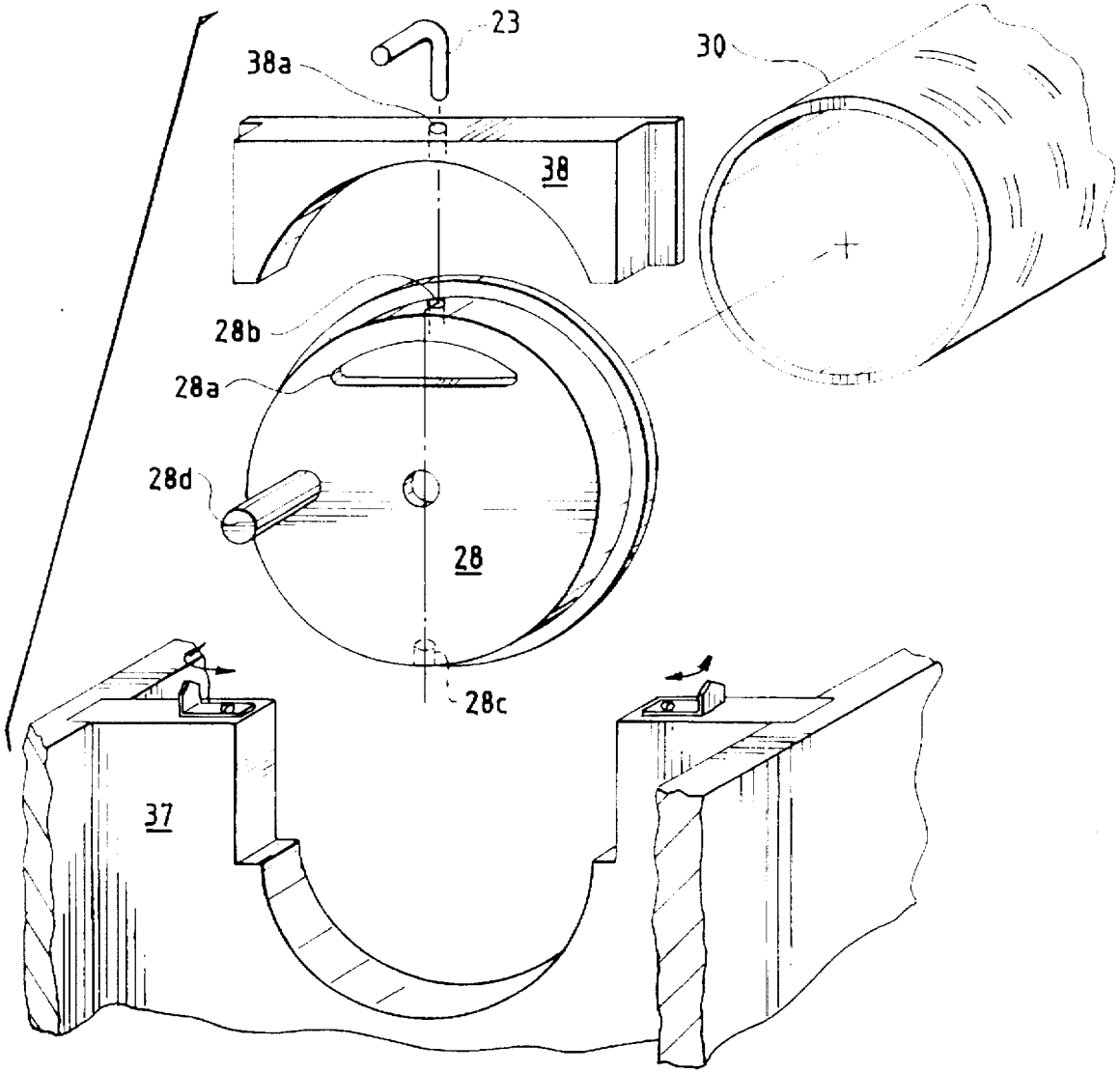
Figure 11A:
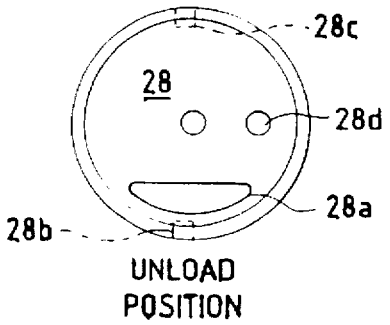
Figure 11B:
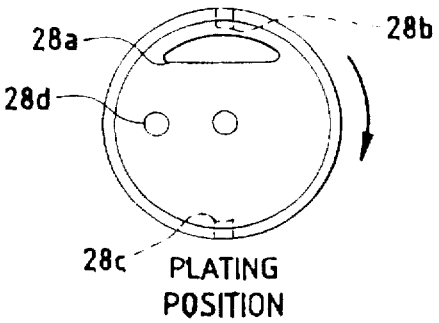
Figure 12:
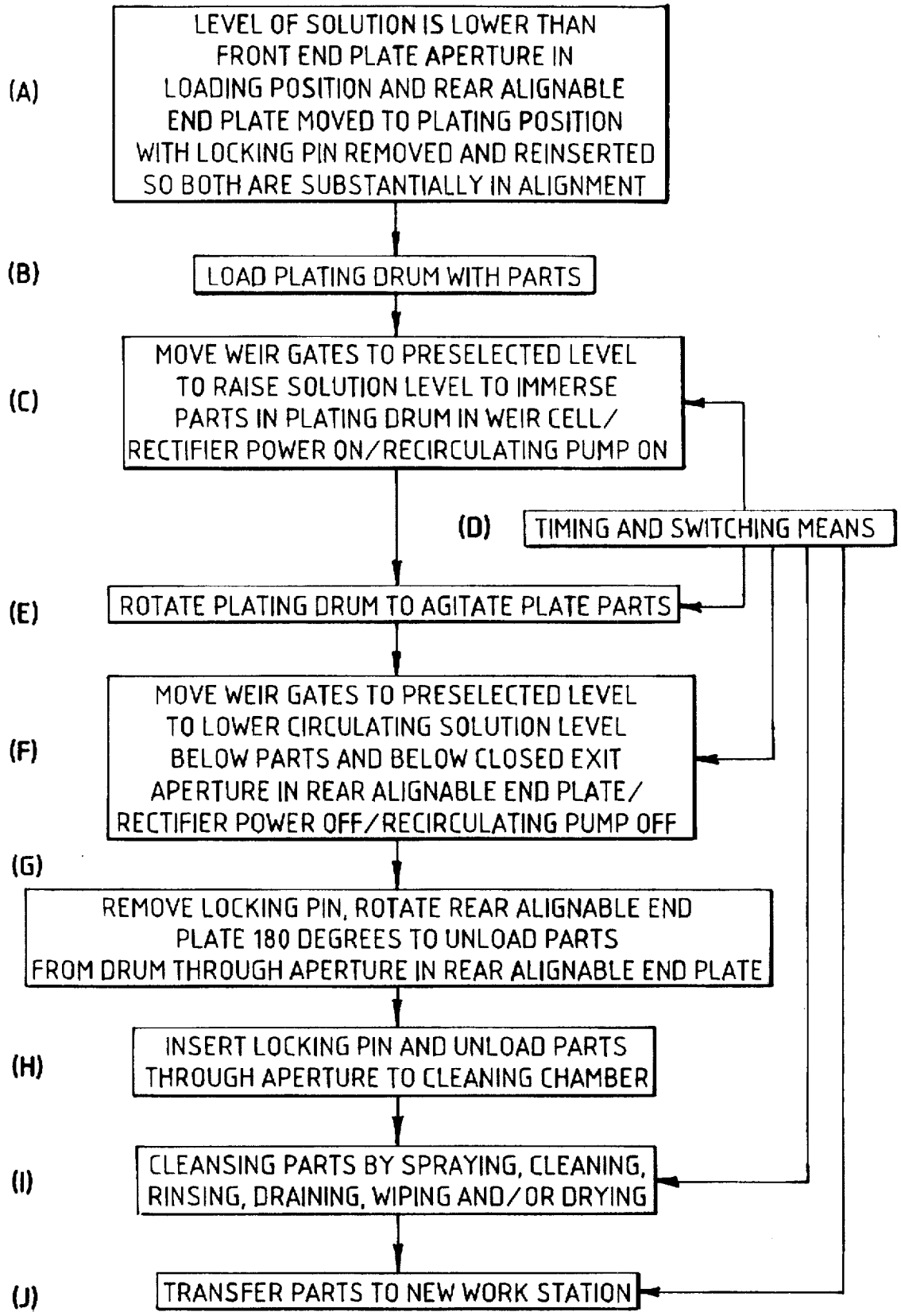

FIG. 1 of the drawing is a prior art schematic of a plating cell;

FIG. 2 of the drawing is an example of a "demonstration" plating drum station as shown from a perspective view imposed from above the plating tank;

FIG. 2A of the drawing illustrates a view of the alignable rear end plate;

FIG. 3 of the drawing illustrates a cross-sectional view taken on a plane passing through line 3—3 in FIG. 2 showing the change in horizontal inclination of the plating drum from loading to unloading position after the unloading handle is fully rotated counter-clockwise;

FIG. 4 of the drawing illustrates a perspective view imposed from above a plating cell showing the plating drum station and the flow of parts into and out of the plating drum station;

FIG. 5 of the drawing illustrates a top view of a plating cell;

FIG. 6 of the drawing illustrates a cut away side view of the plating cell showing the auger-shaped cathode;

FIG. 7 of the drawing illustrates a cross-sectional view taken on a plane passing through line 7—7 looking in the direction of the arrows of the plating cell;

FIG. 8 of the drawing illustrates a sectioned view taken on a plane passing through line 8—8 looking in the direction of the arrows of the plating cell;

FIG. 9 of the drawing illustrates the plating drum, driving gear, and hidden view of auger-shaped cathode;

FIG. 10 of the drawing illustrates an end view of the plating drum assembly;

FIGS. 11, 11A, and 11B of the drawing illustrates a perspective view of a preferred embodiment of the rear end plate disassembled from the drum and how it is assembled to journal the drum as well as be selectably rotatable from the open position (or unload position) to the closed position (or plating position) as seen respectively in FIG. 11A and FIG. 11B; and FIG. 12 of the drawing illustrates a system flow chart of the steps of the process disclosed.

Referring to the drawing (wherein like numbers refer to corresponding parts thereof), FIG. 1 is a prior art schematic of a plating cell, see p. 623, supra. This shows a continuous strip that has an anode proximate to the strip being plated that is located in a process cell that has the liquid in it controlled by weirs in slots or downspouts, so that the reservoir tank can continually receive circulating liquid sumped or drained from the process cell. This regeneration of liquid enriches the process cell with rejuvenated liquid to enable a higher current density available for enhanced plating.

Referring to FIG. 2 of the drawing, is a preferred example of a "demonstration" drum station as shown from a perspective view imposed over a plating tank 21.

FIG. 2 of the drawing illustrates a perspective view from the top showing the drum station that has discrete parts 25 therein that are shown for illustrative purposes as having gone through the electroplating drum 30 and are being deposited in a chamber 50 that can retain the parts 25 for spraying, cleansing and or drying the parts 25 and thereafter exhaust them down an inclined plane or exit chute 22 as shown in FIGS. 2 and 4.

Accordingly, this invention provides as one of its important features a hew and unique drum and process that merges the advantages of barrel plating with continuous line plating. As seen from the drawings, an electroplating drum 30 illustrates a system with continuous unloading and cleansing and drying of the parts 25 as they move from one solution and plating cell to another. This not only creates faster cycles and allows higher current densities, but also has the advantages of less contamination of solutions and improved efficiency with lower costs by having better integrity in the chemistry of the solutions.

As can be seen from the demonstration drum 30 shown in FIG. 2, it is positioned above the plating tank legs 43 where the sides of the reservoir tank (not shown) are supposed to surround the weir gate 26 (not shown) of the plating tank 21 to form a process cell similar to FIG. 1 and the bottom of the reservoir tank rests on the reservoir tank legs 43 as will be more fully explained in this specification.

The demonstration drum shown is actually meant to operate in a continuous process line of drums associated with one or a plurality of operating reservoirs. Thus, it will become clear that the illustration of one demonstration drum is all that is necessary to explain the working of the system and process as defined in the claims.

In FIG. 2 it can be seen that parts 25 are loaded into a hopper 20 and preferably dumped from the hopper 20 by rotating the hopper 20 upward so the parts 25 slide by gravity through the fixed end plate 28 shown in FIG. 2A by going through an opening 28*a* in the end plate 28.

As seen in FIGS. 4, 5, 6, and 11 the plating drum 30 is journalled to rotate within the process cell wherein an anode 24 is in proximity to the plating drum 30 and is curved to conform closely to the circumference of the drum. The anode 24 is a meshed or otherwise perforated conductor that is preferably doubled over and semi-cylindrical.

The drum 30 has one of its ends fixedly associated with a driving gear 31 and its ends are journalled in end plate 27 (not shown) and end plate 28. Alignable end plate 28 is associated with the vertical standard 37 and is apertured to provide egress of parts from the drum to the chamber; and end plate 27 (not shown) is fixed within the standard 37*a* shown in FIGS. 2, 4, and 5 when the journal rotates and it is not alignable as end plate 28. End plate 28 is alignable by rotating it 180 degrees within the standard 37 and a yoke 38 when it is desired to have the aperture 28*a* therein be positioned for unloading or in its open position as shown in FIGS. 11, 11A and 11B. When the parts 25 are exhausted into the drying chamber 50 that enables the parts 25 to be cleansed by being washed, rinsed, and/or dried; then the parts 25 can be transferred to the next processing cell (not shown) once the parts 25 have exited the chamber 50 by falling down the inclined exit chute as shown in FIG. 4 so that a conveyor belt (not shown) can transport the cleansed parts 25 to the next processing cell.

As seen from FIG. 11, the alignable end plate 28 has holes 28*b*, 28*c* formed therein that are 180 degrees apart that each can be aligned with the respective hole 38*a* in the yoke 38 whereby the alignable rear end plate 28 can be allowed to be aligned by rotating it 180 degrees as seen in FIGS. 11, 11A, and 11B.

By removing a locking pin 23 that is positioned to removably protrude through the holes 28*b* and 28*c* to maintain alignment of the alignable rear end plate 28 within the yoke 38, the end plate can be rotated 180 degrees for either loading or unloading of the parts 25 as required. The selective securing means or lock for the alignable end plate 28 is preferably a locking pin 23 that is received by the plating drum yoke 38 to hold the plate in a selective position relative to the aperture 28*a* therein so that at selective times the end plate 28 can be moved, removed or released to enable reorientation of the aperture 28*a* by rotating this end plate 28 depending on whether the process requires the parts to be dumped into the chamber 50 for cleansing at that time. Thus, the aperture 28*a* through the alignable end plate 28 is realignable on the basis of selective activation that can be based on time or some other variable isolated to the chemical make up of the solution.

As seen in FIGS. 6, 7, 8, and 9 the plating drum 30 has a cathode 32 at the center thereof that is preferably shaped as an auger so the parts 25, as they are being processed can be advanced toward the chamber 50 as the plating drum 30 rotates.

The plating drum 30 is preferably shown with slots 36 and agitators (not shown), so that as it rotates it creates a greater agitation and intimacy between the parts and liquids therein to enhance the plating or rinsing or whatever the mode the process is in.

The electrical and fluid connection and agitation means are not shown since they are state of the art or conventional art in plating devices of this type but they are represented in the flow chart at FIG. 12 which defines the sequence of the process steps in the system.

The system flow chart in FIG. 12 explains the process steps of one stage of the demonstration barrel system in order to illustrate how it is contemplated to run the system.

Referring to the drum plating system flow chart, the electroplating system and process has means for loading parts 25 from the plating drum 30 as denoted in Box B, as described herein. This is preferably shown by the hopper 20 being loaded and guiding the parts 25 through the opening 27*a* shown in FIG. 2*a* in the fixed end plate 27.

The system has appropriate switching and timing means shown in Box D for causing the plating drum 30 to receive and exhaust parts. The switching and timing means also causes raising and lowering of the level of chemical solution 33 in plating by raising the weir gate 26 to appropriate preselected levels for plating and for emptying the plating tank 21.

The system and process uses a recirculation pump (not shown) to sump and return rejuvenated chemical solution 33 from the reservoir (not shown) to the plating cell/tank 21. The timing and switching means shown in Box D also controls the rotation of the plating drum 30 and agitation of the parts 25 therein as denoted in Box E as well as the intensity and amount of electric power applied to the anode 24 and auger-shaped cathode 32 as shown in Box C during the rotation of the plating drum 30.

At the conclusion of a plating drum rotation cycle as denoted in Box E, the weir gate 26 can be moved to bring the level of the chemical solution 33 below the bottom of the plating drum 30 as denoted in Box F. The alignable end plate 28 is aligned by removing the pin 23, rotating the alignable end plate 28 for 180 degrees, and reinserting the pin 23 to permit the unloading of parts 25 from the plating drum 30 as denoted in Box G. The single plating drum 30 and single plating tank 21 described in this disclosure comprise a plating cell unit which can be part of a system comprising a plurality of plating cells that are incorporated into the electroplating system and process herein described.

Also, the loading end of the plating drum 30 may be raised by rotating the unloading handle 29 to facilitate unloading of parts 25 through the exit aperture **28*a*** by action of gravity.

The exit aperture **28*a* is then closed by removing the pin 23 and aligning the alignable end plate 28 by rotating it 180 degrees, and reinserting the pin 23 to lock the alignable end plate 28** in a closed position as denoted in Block H.

The unloaded parts 25 exit the plating drum 30 through the exit aperture **28*a*, into a cleansing chamber as denoted in Box I. The cleaned and dried parts 25 are transferred to a new work station through exit chute 22** for another plating cycle as denoted in Box J.

As stated earlier, rotation of the plating drum with an auger-shaped cathode creates a more thorough contact with the parts; and the cylindrical shape of the anode allows a more uniform and higher current density. The drum is rotatable and it is loaded or unloaded with parts at each plating cell. The parts may be unloaded, cleaned and/or dried at each plating cell giving the advantage of minimizing the contamination of electrolyte in successive plating cells with electrolyte from preceding plating cells. The process of the plating system is enhanced by means of substantially vertical moveable weirs whereby the level of the electrolyte or chemical in each plating cell within the electroplating system can be maintained at preselected levels, thereby permitting parts to be transported between plating cells within the electroplating system during the process and thus providing the advantage of eliminating transporting of the plating drums wherein the parts are electroplated. The front and rear end plates are finely timed with each other to allow loading and unloading of parts and enable the parts to be delivered as cleansed parts at each cell in the process and thereby accomplish many of the objects as stated.

It should be realized that the present invention is an advantage over the previous alternative systems and processes including continuous line plating and barrel plating. Unlike continuous line plating, discrete parts may be plated in the present invention and, unlike barrel plating, the plating drums in the present invention remain rotatable in each plating cell and are not transported to successive plating cells during the process.

This gives the advantage of a more efficient and quicker electroplating process by maintaining the chemical solutions and the parts in a substantially clean and uncontaminated condition during the process. This also gives the advantage of depositing a more uniform and purer finish and a decreased cycle time over either the continuous line plating or barrel plating processes.

It may thus be seen that the objects of the present invention set forth herein as well as those made apparent from the foregoing description are efficiently obtained. While preferred embodiments of the invention have been set forth for purposes of disclosure, modification of disclosed embodiments of the invention as well as other embodiments thereof may occur to those skilled in the art. Accordingly, the appended claims are intended to cover all embodiments which do not depart from the spirit and scope of the invention.

That which is claimed is:

1. An electroplating system comprising: a tank of electroplating chemical solution that is recirculated during processing of parts to be plated in a rotatable electroplating drum that is perforated and weir gate means operatively associated with the tank for keeping the solution at a preselectable level to enable said electroplating system to process the parts fed to it, said electroplating drum having a front end, a rear end, an inside, and an outer circumference that is at least partially immersed in the electroplating chemical solution, at least a cathode located within the drum, said cathode comprising a helical conductor fixedly engaged to said drum, said cathode serving as a driver to move the parts through the drum when the drum is rotated as well as said cathode, means for rotating, loading, and unloading the parts located in the electroplating drum, means for cleansing the parts that have been electroplated after they have been loaded and processed and thereafter unloaded from the drum.

2. A system as defined in claim 1, further comprising a fixed front end plate at the front end of said drum, wherein an aperture is defined above the level of the chemical electroplating solution and communicates with the inside of said drum and enables the parts to be loaded in said drum.

3. A system defined in claim 2, wherein said electroplating solution has a preselected level which is below said aperture in said fixed front end plate, to enable the aperture to accept the parts without losing the chemical electroplating solution through said fixed front end plate.

4. An electroplating system, as defined in claim 1, wherein an alignable rear end plate is provided at the rear end of the drum, said rear end plate having an open and a closed position and means for aligning said plate and locking said plate in either the open or closed position, said rear end plate having an aperture that is positioned to enable said parts to be exhausted from said drum through said aperture for purposes of cleansing said parts when said rear end plate is in the open position.

5. A system as defined in claim 4, wherein a chamber means for cleansing is associated with said system to spray, clean, wipe, rinse, or dry said parts exhausted through said rear end plate.

6. A system as defined in claim 4 wherein said alignable rear end plate has at least a locking pin for selectably locking said rear end plate to anchor the same either in the open or closed position.

7. A system as defined in claim 6 wherein said open position of said alignable rear end plate is locked where said aperture is below the preselectable solution level of said tank, and communicates with a chamber for cleansing by spraying, drying or wiping, and said alignable rear end plate is locked in said open position to enable the parts from the drum to enter said chamber means after having been processed through said drum.

8. A system as defined in claim 7 wherein said aperture is above said solution level in the closed position and said rear end plate has been rotated 180 degrees from the open position after removing said locking pin and then replacing said locking pin in said rear end plate to removably lock the same in place in said closed position.

9. A system as defined in claim 7 wherein said alignable rear end plate can be rotated 180 degrees from the open position to the closed position when said pin is removed and thereafter by reorienting said rear end plate back to the closed position to removably lock the same in the closed position by reinserting said pin.

10. A system, as defined in claim 4, wherein said drum is journalled for rotation in both of said end plates, and is associated with a gear driving means for rotation and both of said end plates are adapted to accept and journally support said drum for rotation.

11. A system as defined in claim 4, further comprising manual means to enable tipping the drum to promote further unloading of the parts through said aperture in said rear end plate.

12. A system as defined in claim 1 wherein the anode is external to and proximate to the drum, said anode extending along and conforming with a portion of the outer circumference of the drum in an arcuate manner.

13. An electroplating process carried out with an anode and a cathode having means for loading and unloading an electroplating drum through the front and rear ends of the electroplating drum without removing said drum from an electroplating chemical solution into which it is immersed during electroplating, wherein electroplated parts are cleansed by spraying, cleaning, drying, or rinsing the parts after being unloaded from one end of the electroplating drum while the electroplating drum is at least partially immersed in the electroplating chemical solution and the drum has an alignable rear end plate having an aperture that is rotatable 180 degrees from a closed position for electroplating to an open position where the parts are exhausted from said electroplating drum for cleansing and switch and timing means for causing the electroplating drum to rotate as well as receive and exhaust the parts for cleansing at selected times, a reservoir for the electroplating chemical solution and pumps to circulate the electroplating chemical solution to effect efficient electroplating and weir cell gates that maintain a preselected level of the electroplating chemical solution in a weir cell that is activated and controlled at selected times by the switch means comprising the steps of:

(a) closing the aperture in the alignable rear end plate by rotating the rear end plate 180 degrees and removably locking the plate into a fixed position;

(b) loading the parts to be electroplated into the electroplating drum;

(c) raising the electroplating chemical solution to the preselected level by moving at least a partially vertical weir cell gate to the preselected level, to immerse the parts in the electroplating chemical solution in a weir cell;

(d) actuating switch means to agitate the parts in the electroplating drum by rotating the cathode and the electroplating drum while electroplating the parts and to control loading, unloading, agitation of the parts and rotation of the electroplating drum, a preselected weir cell gate height, and intensity and amount of electric power applied to the cathode and an anode;

(e) recirculating the electroplating chemical solution in the weir cell to replenish, regenerate, and enrich the weir cell with rejuvenated electroplating chemical solution from the reservoir;

(f) moving the weir gates at a termination of the agitation to drain the chemical electroplating solution from the weir cell;

(g) aligning the aperture of the alignable rear end plate and unloading the parts from the electroplating drum for at least spraying, drying, wiping, or rinsing the parts and achieving optimum means for the continuous electroplating of the parts without contaminating successive electroplating solutions.

14. An electroplating process that electroplates parts in an electroplating drum having an anode and having an electroplating chemical solution and recirculating pumps to circulate the electroplating chemical solution and to maintain a preselected level of the electroplating chemical solution in the electroplating drum to effect efficient plating of parts, means for loading and unloading the electroplating drum having openings located in front and rear end plates of the drum, switch timing means and cathode means contained in said drum, and shaped to cause electroplating as well as movement of said parts toward the rear of the drum when the drum rotates, and means for unloading the parts through said rear end plate for cleansing the parts by spraying, wiping, drying or rinsing the parts, comprising the steps of:

(a) providing a supply of the electroplating chemical solution for said electroplating system;

(b) loading said parts in said drum;

(c) raising the electroplating chemical solution to a preselected level;

(d) energizing the electroplating drum, the cathode means, the anode and the recirculating pumps;

(e) rotating the electroplating drum and cathode means to electroplate the parts as well as cause the parts to agitate and move toward the rear end plate of the electroplating drum; and (f) removing said parts from said drum through an opening in the rear end plate.

15. A process as set forth in claim 14, comprising the step of:

(g) cleansing by at least spraying, drying, wiping, or rinsing the parts, and expelling the parts for treatment in a new work station.

* * * * *